US005172742A

United States Patent [19]

Iwasaki et al.

[11] Patent Number: 5,172,742

[45] Date of Patent: Dec. 22, 1992

[54] PANEL SHUTTER DEVICE

[75] Inventors: Hiroshi Iwasaki; Masaru Tanaka; Hiroshi Kimura; Yoshihiro Uesugi, all of Tokyo, Japan

[73] Assignee: Sanwa Shutter Corporation, Tokyo, Japan

[21] Appl. No.: 678,638

[22] Filed: Apr. 1, 1991

[30] Foreign Application Priority Data

Apr. 2, 1990 [JP] Japan ..... 2-84937
Apr. 2, 1990 [JP] Japan ..... 2-84938
Mar. 12, 1991 [JP] Japan ..... 3-72295

[51] Int. Cl.[5] ..... E06B 3/92
[52] U.S. Cl. ..... 160/36; 160/32
[58] Field of Search ..... 160/36, 32, 35, 33, 160/220, 310, 188, 201

[56] References Cited

U.S. PATENT DOCUMENTS 4,595,043 6/1986 Nozawa et al. ..... 160/36
4,662,420 5/1987 Hirao ..... 160/32
4,838,331 6/1989 Kasai ..... 160/36
5,065,806 11/1991 Kondoh ..... 160/36
5,072,766 12/1991 Kondoh et al. ..... 160/36

*Primary Examiner*—David M. Purol
*Attorney, Agent, or Firm*—Ladas & Parry

[57] ABSTRACT

A panel shutter device constructed in such a way that in the process of continuously moving each panel by a lifting shift along guides rails and a lateral shift along a housing rail, a guide rotary member engages or disengages a guide shaft projecting from the side of the panel opposite the driven side. At the time of descending of the shutter curtain, in order to prevent finger pinching as each panel is placed on the succeeding panels sequentially, each panel can be lifted or descended without causing a gap between panels of the shutter curtain by providing the support member suspended by a pivotable connecting chain.

11 Claims, 8 Drawing Sheets

PANEL SHUTTER DEVICE

BACKGROUND OF THE INVENTION

1. Field of the Invention

This invention relates to a panel shutter device, and more particularly to a device for securing a continuously moving shutter curtain carrying a number of panels in both closing and opening operations and for insuring safety at the time of lowering the panel by the construction in which a plurality of panels forming the shutter curtain are suspended by connecting chains, and an opening in the wall of a building is closed and opened by a continuous movement of the curtain panels with both lifting shifts and lateral shifts by means of reversible sprockets.

2. Brief Description of the Prior Art

In this description of the term "continuous moving", and like terms, is intended to mean the sequential movement of panels from vertical movement in vertical guide means to horizontal movement into the storage housing along horizontal guide means, and vice versa.

Conventional panel shutters are constructed in such a way that roller shafts projecting on both side surfaces of the upper panels of a plurality of panels are connected by means of respective connecting chains to form a shutter curtain. When these curtains are drawn into a housing as the curtain is opened, the loose portions of the connecting chains are suspended by being meshed with sprockets disposed in the housing on rails provided for back and forth (horizontal) movement at both right and left sides in the housing case. The housing case is disposed on upper end portions of guide rails erected on both sides of the opening of the building, and the shutter curtain is lifted or lowered by interlocking with the reversible motion of the sprockets to open or close the opening portion of the building.

When the sprockets are turned clockwise, each panel closing the opening, by being disposed at equal intervals in vertical flat form along the guide rails, is lifted in the vertical direction by means of the connecting chains, and guide rollers journalled on the roller shafts projecting on both side surfaces of each panel are shifted upwardly by being guided within the guide rails. Moreover, the guide rollers of the top panel is continuously carried onto the horizontal housing rails, positioned on the inner right and left side plates of the housing case, through a sequential continuous movement process by action of the sprockets. Each panel, as it reaches the top, is laterally shifted along with the rolling of the guide rollers, and when all panels are disposed in the housing case, and the bottom surface of the bottom panel is upwardly shifted and is aligned with the bottom surface of a lintel portion of the housing, the lifting is stopped.

Also, when the rotation of the sprockets is reversed, the bottom panel descends and shifts along the guide rails, and each panel journalled on the housing rails in the housing case laterally shifts on the housing rails sequentially, and each panel shifts to the guide rails sequentially from the lower end side of the panel due to the continuous movement process of the sprockets, and each panel descends and shifts along the guide rails where they become suspended on the connecting chains, and each panel is disposed again in vertical flat formation, being supported by the guide rail to close the opening of the building.

This type of panel shutter, performing an opening or closing operation as described in the foregoing, advantageously does not cause friction or a collision between the panels or between the panel and the guide rails at the time of opening or closing of the shutter curtain, and thus they do not produce an uncomfortable noise as compared with a lifting shutter of an even earlier prior art take-up system in which the top and bottom edges of an elongate steel slab are journalled and connected in the vertical direction to form a shutter curtain. This type of shutter curtain is rolled up by means of a take-up shaft mounted rotatably in the housing case, or is rewound to open or close the opening of a building. Prior art shutter curtains of the first type gain recognition for their excellent function by shops in underground areas where sounds are resonated easily or by shops in housing areas, and where there is a demand for an optimum shutter curtain design. However, the conventional shutter has the following drawbacks with respect high speed operation and also with respect to safety during opening or closing.

In view of the continuous movement property of the panels, the panel shutter of this kink of prior art shutter curtain was constructed in such a way that in the continuous movement process, the panels were carried continuously on to the housing rails after being released from the guide rails, or were continuously carried from the housing rails to the guide rails again. Since the shifting direction of the panel was converted from horizontal movement to vertical movement where the upper end of the panel is now suspended, the lower end side of the panel became the free end, and the panel was free to swivel or swing in the back and forth direction with the roller shaft acting as a fulcrum. By the inertia motion, and when this swinging action occurs the lower side of the panel can get hooked on the housing or guide rails, and the panel cannot be continuously carried on the housing rails or the guide rails resulting in the inability of proper ascending or descending, whereby an accidental breaking the panel occurs. The swinging amplitude became bigger in proportion to the opening or closing speed, and also the size of width of the opening, namely, the problem is aggravated in proportion to the mass of the panels, particularly, by the collisions of the mutual panels rolling on the housing rails. In such a case, the continuous movement became impossible, and the shutter curtain mechanism was unable to deal with the opening or closing of the shutter curtain at a high speed.

Under the circumstances, a method of providing a guide shaft at the lower end side of the panel and providing a guide member to guide the guide shaft and to introduce it to the guide rails was used. But this type of shutter curtain apparatus was still unable to deal with the high speed opening or closing of the shutter curtain which resulted in a collision between the guide shaft and the guide member. This shutter curtain apparatus could not eliminate the problem, and a panel shutter device capable of dealing with the high speed opening or closing was demanded from users.

As to safety, the panel shutter of this kind was constructed in such a way that each panel forming the shutter curtain was positioned at equal intervals in the vertical direction and connected by means of the connecting chains, so that when the opening in the building was closed, in a process where each panel was sequentially placed on the panel beneath it there was a danger of injury by pinching a finger inadvertently in the gap between each panel. As a result, as a safety countermeasure for preventing finger pinching, methods were developed for using a lifting chain connected to the bottom panel and separating the mutual panels just before coming to the housing case, thereby avoiding creating a gap between each panel at the time of lifting or shifting, as disclosed in the official gazettes, Japanese Utility Model Laid-open Publication No. Sho 62-88087 or Japanese Utility Model Laid-open Publication No. Sho 62-94293 previously filed by the present applicant, Japanese Utility Model Laid-open Publication No. Sho 63-1195, or Japanese Patent Laid-open Publication No. Sho 63-55298. However, these methods not only brought about problems of requiring reinforcement of the connection to the bottom panel and to the bottom panel itself due to the application of the full load of all the panels on the connecting portion of the lifting chain including the bottom panel, but also, the methods required a special guide rail for guiding the lifting chain. Because of this requirement, if the panel shutter was large in size, a higher degree of reinforcement of the connection and the bottom panel had to be made according to the larger size, so that, for example, in a large size building that had an opening to be installed with a normal panel shutter, a height of which was more than a double the height of the ordinary opening, the installation of a conventional panel shutter with the finger pinching avoidance structure was regarded impossible.

Accordingly, the present invention has been conceived to eliminate the drawbacks of the conventional panel shutters and to secure high speed continuous operation during opening of closing, and to secure the safety of operation during opening or closing. It is a primary object to provide a panel shutter device in which a forced guide mechanism is provided to guide the panel forcedly from the guide rail to the housing rail or from the housing rail to the guide rail smoothly. The smoothness of the continuous movement of the panels in both ascending and descending movement prevents hooking of succeeding panels even if the panel shutter is made to open or close at a high speed.

Another object of this invention is to provide a panel shutter device in which, in order to secure safety against finger pinching during the operation of placing each panel on panels beneath it during the time of descending of the shutter curtain, each panel is suspended by a connecting chain by means of a support shaft without using a lifting chain that is directly suspended from a bottom panel, and each panel is lifted without causing a gap on each panel of the shutter curtain, in spite of the foregoing construction, and there is no need of providing the lifting chain separately which, accordingly, eliminates the necessity of reinforcement of the connection to the bottom panel that bears the total load of the panels or of providing a special guide rail to guide the lifting chain, and thus, the feature of avoiding finger pinching is realized with a relatively simple construction.

Still another objection of this invention is to provide a panel shutter device capable of avoiding finger pinching even in a panel shutter device capable of smooth continuous movement of the panels at high speed opening or closing of the shutter curtain.

DISCLOSURE OF THE INVENTION

This invention has a basic construction of the type of panel shutter which comprises a shutter curtain in which support shafts that axially support guide rollers project from side surface portions of both sides of each panel of a plurality of panels. The panels are suspended by means of connecting chains to form a series of panels. Guide rails are erected on both right and left sides of an opening in the wall of a building to guide the vertical lifting and horizontal shifting of each panel. A housing case is installed on an upper ends of the guide rails, and housing rails are installed in the horizontal, back and forth, direction on the inside surface of right and left side plates of the housing case to house each panel as it is continuously carried from the guide rail into the housing case in the vertical side-by-side arrangement, and sprockets that suspend the chains are positioned on both right and left sides in the shutter case to perform the continuous movement of each panel along the guide rail and the lateral shift along the housing rail by the reversible rolling thereof, whereby the shutter curtain is lifted or lowered to open or close the wall opening.

The first embodiment of the invention is constructed in such a way that the upper side of each panel forming the shutter curtain is suspended by the connecting chain by means of the support shaft, and when the panels are collected in the housing case, the connecting chain is suspended on the sprockets disposed in the housing rail in the housing case, and the panels are mutually and continuously carried by the lifting movement along the guide rail and the lateral shift along the housing rail by interlocking with reversible rolling sprockets. In this continuous movement process, the swinging motion which would ordinarily occur at the lower side of the panel is prevented due to the function of a guide rotary member, and the swinging at the lower side of the panel is prevented by engagement or disengagement of the guide shaft projected from the lower side of each panel by means of the guide rotary member. In case the shutter curtain is made to open or close at a high speed as described in the foregoing, heretofore, the lower end side of the panel functions as a free end to swivel in the horizontal direction with the support shaft acting as a fulcrum by the motion inertia, and the succeeding panel becomes hooked and the panel is not continuously carried on the housing rail or the guide rail which results in the inability of the ascending or descending of the panel. By the functioning of the guide rotary member, an accidental breaking the panel the may be prevented, and moreover, the danger of injury resulting from finger pinching due to the high speed opening or closing may be avoided.

The second embodiment of the invention is constructed in such a way that the arrangement and construction of the member are respectively opposite those described in the first invention. Namely, the lower side of each panel forming the shutter curtain is suspended by the connecting chain by means of the support shaft, and when the panels are collected in the housing case, the connecting chain is suspended on the sprockets disposed in the lower part of the housing case along the guide rails, in the housing case, and the panels are mutually and continuously carried by the lifting movement along the guide rail and the lateral shift along the housing rail by interlocking with reversible rolling sprockets. In this continuous movement process, the swinging motion which would ordinarily occur on the upper side of the panel is prevented due to the function of a guide rotary member provided in the vicinity of the guide rail, and the guide shaft projected on the upper side of each panel is engaged or disengaged by the guide rotary member to prevent the swinging at the upper side of the panel. The lower side of the panel is made to shift always prior to the shift of the upper side of the panel by the forced guide mechanism as described in the foregoing, and particularly, since the shift of the panel to the guide rail at the lower side of the panel at the time of closing is faster, a time lag caused by the swinging of the upper side of the panel can be ignored when compared with the case where the swinging occurs at the lower side of the panel. Moreover, the upper side of the panel is engaged with the guide rotary member so that the positive continuous movement can be secured even if swivel motion occurs at the lower side of the panel. Accordingly, in case the shutter curtain is made to open or close at a high speed, there is no problem in the high speed shifting of the.

Finally, the third embodiment of the invention is constructed in such a way that a large diameter ring-like member, whose outside diameter is larger than that of the sprocket, is integrally mounted on the outside surface of the sprocket that suspends the connecting chain to be suspended on the support shaft projecting from the side of each panel forming the shutter curtain. The suspending portion is provided with a swivellable panel support member, and when this support member passes the sprocket, it is engaged with the outer peripheral surface of the ring-like member to interlock with the continued rotation of the sprocket, so that the shifting amount of the support shaft becomes gradually larger as compared with the shifting amount of the connecting chain, and the panels are lifted in the unseparated condition, and are gradually separated to effect the continuous movement. Accordingly, an extremely simple construction of merely providing the ring-like member and the panel support member can be obtained which eliminates the conventional complicated construction accompanied by the prevention of finger pinching.

DETAILED DESCRIPTION OF THE PREFERRED EMBODIMENTS

Figure 1:
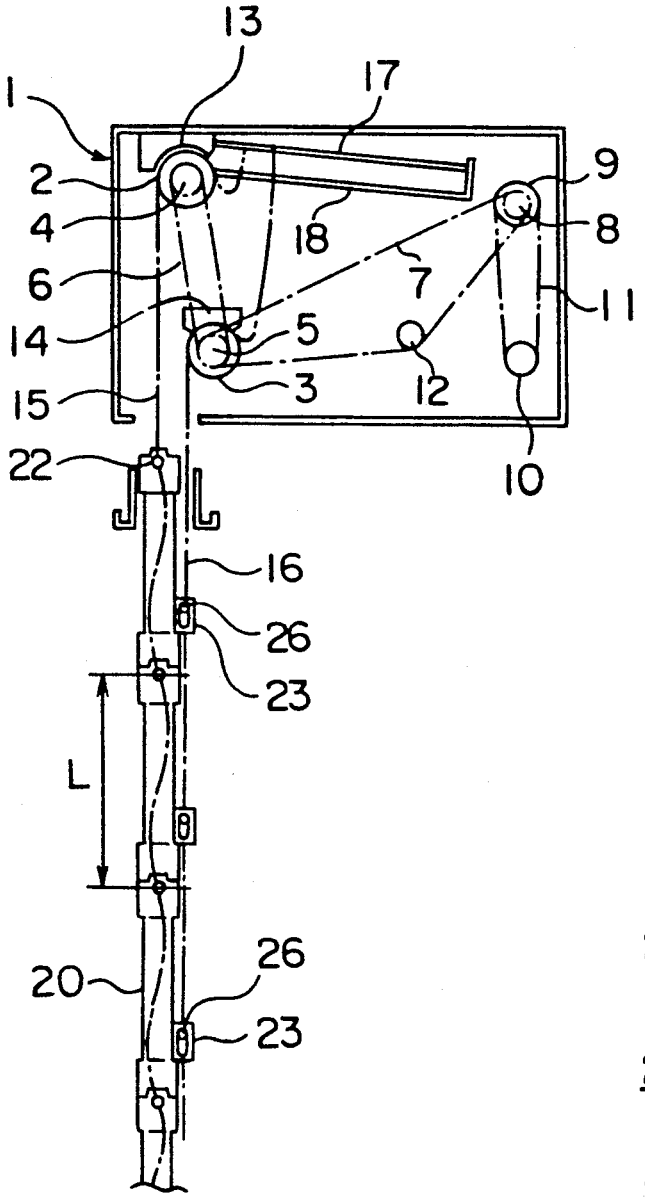
FIG. 1 is a side view of a panel shutter representing an embodiment of the first embodiment of the invention.

This invention will be described in detail on the basis of attached drawings in the following.

FIG. 1 through FIG. 4 are views representing a first embodiment of the invention, and reference numeral 1 denotes a housing case disposed in the upper part of an opening in a wall. A sprocket 2 and a guide rotary member 3 are rotatably disposed at a predetermined interval (for example, its height may be equal to the height of the panel 20 to be described hereinafter) in the vertical direction at both sides of the housing case 1. The sprocket 2 and the guide rotary member 3 are rotatably driven by an endless chain spanned between sprockets 4 and 5 mounted on the rotary shaft supporting both the members 2 and 3 at the same speed synchronously. The guide rotary member 3 is coupled with a sprocket 9 mounted on a middle shaft 8 by means of an endless chain 7, and this middle shaft 8 is connected to an opening/closing drive unit 10 by means of an endless chain 11. Reference numeral 12 denotes a tension roller that gives tension to the endless chain 7.

The sprocket 2 and the rotary member 3 are provided with chain holders 13 and 14, and a connecting chain 15 serving as a panel suspending member and connecting belt 16 are spanned on the sprocket 2 and the guide rotary member 3, respectively. The ends of connecting chain 15 and connecting belt 16 are slidably engageable with a chain guide 17 which is disposed slating downwardly and rearwardly from the position of sprocket 2.

The sprocket 2 and the guide rotary member 3 have the same pitch, but the number of teeth (not shown) of the sprocket 2 is greater than the number of teeth of the guide rotary member 3, and the linear lifting speed $V_1$ of the connecting chain 15 and the linear lifting speed $V_2$ of the connecting belt 16 are set to satisfy, for example, the following formula (1).

$$(V_1 - V_2)T = \Delta L \qquad (1)$$

Wherein T denotes a time necessary for raising the panel 20 (by the connecting belt 16) by its height L, and $\Delta L$ denotes the linear deviation of the connecting chain 15 and the connecting belt 16 in the time T, and $\Delta L$ also equals the spacing between adjacent ends of the panel 20 that just reaches the position of sprocket 2 and the panel 20 just below it (See FIG. 3).

Also, at the rear side of the sprocket 2, a horizontal housing rail 18, for guiding an upper guide roller 22 of the panel 20 to be described hereinafter, is disposed in parallel with the chain guide 17.

A plurality of panels 20, 20 . . . forming the shutter curtain are suspended on the connecting chain 15 and on the connecting belt 16 at both right and left sides of the panel shutter.

Figure 2:
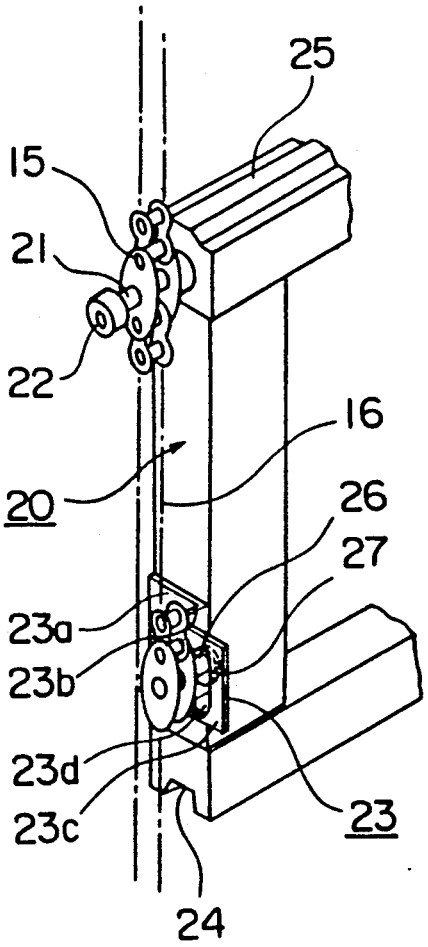
FIG. 2 is a perspective view of a part of side end view of the panel.

Panels 20, as shown in FIG. 2, are provided with a support shaft 21 at the upper side of both left and right end surfaces, and the support shaft 21 projects outwardly. The upper guide roller 22 is mounted on the tip of the support shaft 21, and a guide shaft mounting plate 23 is mounted at the lower end portion of the panel side. Moreover, a concave groove 24 for fitting is formed on the lower end surface of each panel 20, and a convex rib 25 for fitting into the concave groove 24 is formed on the upper end surface of each panel 20.

The guide shaft mounting plate 23 is shaped in the form of a crank in plan view by means of a bent mounting plate portion 23*a* fixed to right and left end surfaces of the panel 20, a middle plate portion 23*b* bent in right angle from its front edge, and a guide plate portion 23*c* bent in right angle in parallel with the mounting plate portion 23*a* from the middle plate portion 23*b*, and the guide plate portion 23*c* is formed with a long rounded hole 23*d* extending in the vertical direction.

The support shaft 21 of each panel 20 is mounted on the connecting chain 15 at a predetermined pitch ($L+\Delta L$) obtained by adding the deviation difference $\Delta L$ to the panel height L. A guide shaft 26, projecting at intervals equal to the panel height L relative to the connecting belt 16 is inserted into the long circular hole 23*d* of the guide shaft mounting plate 23, and a stop ring 27 is fitted to its tip.

Next, the operation of the foregoing embodiment is described. As shown in FIG. 1, the shutter curtain is closed as each panel 20 descends, and the concave groove 24 and the convex rib 25 of the mutually engaging panels are fitted together.

At this time, as the support shaft 21 of the panel 20 is mounted on the connecting chain 15 at a pitch ($L+\Delta L$). Therefore, the connecting chain 15 is loose, and the connecting belt 16 (having guide shaft 26 spaced at a pitch L) becomes tensioned.

In this condition, in case the opening/closing unit 10 is operated to rotatably drive the sprocket 2 and the guide rotary member 3 in the clockwise direction when viewed in FIG. 1, since the connecting belt 16 to be driven by the guide rotary member 3 is in a tensioned condition, the whole curtain of panels are jointly lifted according to the rotation of the guide rotary member 3. At this time, since the number of teeth of the sprocket 2 is greater than the number of teeth of the rotary guide member 3, the linear lifting speed of the connecting chain 15 to be driven by the sprocket 2 is faster, and the top panel 20 is thus lifted faster than the panel 20 positioned underneath, and as shown in FIG. 3, the top panel 20 floats to cause a gap $\Delta L$ with respect to the panel 20 at the next lower position, and the concave groove 24 and the convex rib 25 are disengaged.

At this time, the guide shaft 26 of the connecting belt 26, being engaged in the long circular hole 23*d* of the guide shaft mounting plate 23, permits uninterrupted floating of the top panel 20.

When the support shaft 21 and the guide shaft mounting plate 23 of the panel 20 reach the positions of the sprocket 2 and the guide rotary member 3, respectively, and they turn almost half the periphery of sprocket 2 and guide rotary member 3, the upper guide roller 22 is engaged with the housing rail 18, and the panel 20 is in the suspended condition on the housing rail 18.

Thereafter, the upper panels 20 slide along rail 18 sequentially according to the rotation of the sprocket 2 and the guide rotary member 3, and the upper guide roller 22 turns around the sprocket 2 to be engaged with the housing rail 18 to push the preceding panel 20 backward.

As explained in the foregoing, when each panel 20 is sequentially housed in the housing case 1, and the lowest end of bottom panel 20 is housed in the housing case 1, the shutter curtain is in full open condition, and the drive of the opening/closing unit 10 is stopped.

During the raising of the panels 20, since each panel 20, excluding the panels 20 floated in the upper housing case 1, is supported by the connecting belt 16 respectively, the load of the panels above the bottom panel 20 is not applied to the bottom panel 20, and accordingly, the mechanical strength of the bottom panel 20 in the vertical direction can be minimized.

Figure 3:
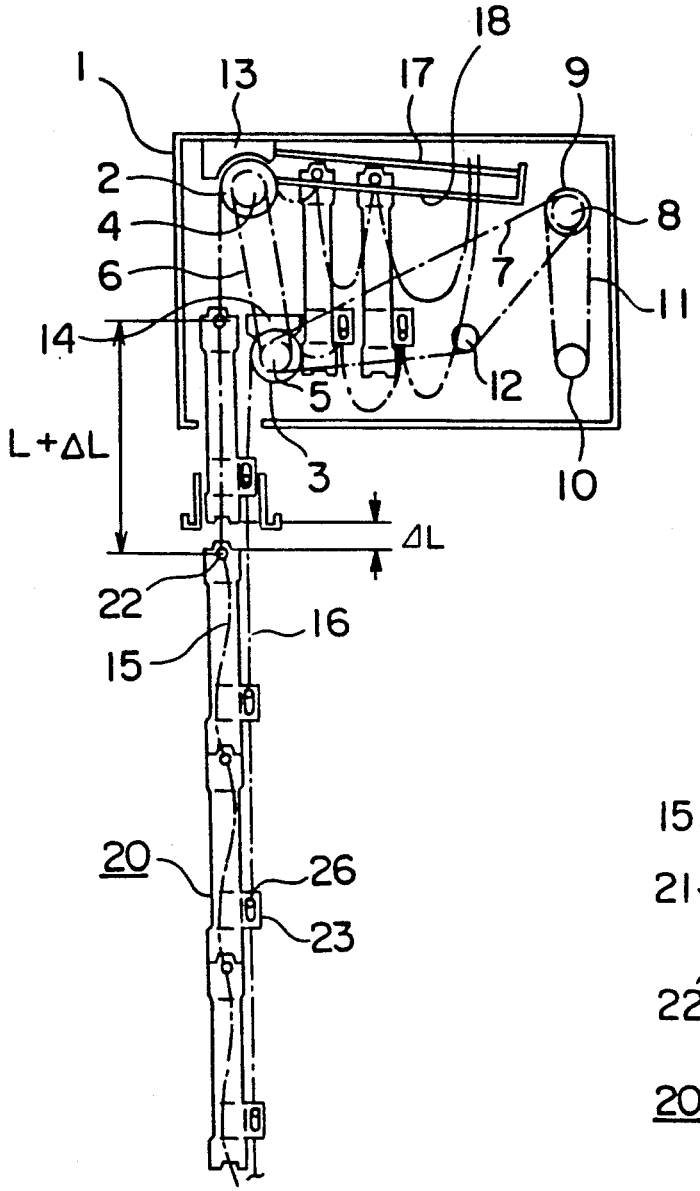
FIG. 3 is a side view representing a housed condition of panels.

Also, when the opening/closing unit 10 is rotatably driven in the direction opposite thereof from the condition where the whole panels 20 are housed in the housing case 1, and the sprocket 2 and the guide rotary member 3 are rotatably driven in the reverse direction when viewed in FIG. 3, the bottom plate 20 descends first.

At this time, since the guide shaft 26 of the connecting belt 16 adjacent the lower end of the long rounded hole 23*d* of the guide shaft mounting plate 23, the panel 20 is suspended by the connecting chain 15 to be driven by the sprocket 2 (of the faster rotating speed) in the beginning, and as the panel 20 descends, it does so relative to the guide shaft 26 on account of the slower linear lowering speed of the connecting belt 16, and finally, the guide shaft 26 engages the upper end of the long circular hole 23*d* of the guide shaft mounting plate 23, and the descending of the panels 20, as they leave housing case 1, are controlled, and the panels 20 descend at the linear lowering speed of the connecting belt 16.

Each panel 20 is sequentially disengaged from the horizontal housing rail 18 to start its descent, and similar to the foregoing, the panel 20 descends while being guided by the connecting belt 16, and the convex rib 25 of the upper end surface of the panel 20 beneath is fitted into the concave groove 24 of the lowest end surface to stop the descending relative to the connecting belt 16.

In the following similarly, when each panel 20 descends, and each panel 20 is fitted to the preceding panel 20 at the position slightly lower than the housing case 1, and when the bottom panel 20 touches the ground, the drive of the opening/closing unit 10 is stopped, and the shutter curtain is closed.

As described in the foregoing, in continuously moving the shutter curtain to its open position, a delay at the lower side of the panel (just ready to be placed on rails 18) is required due to the fact that the panel end at the side of the sprocket 2 is carried slightly faster than the panel end at the side of the guide rotary member 3. This delay is prevented by carrying out the engagement or disengagement of the guide shaft 26 forcedly by means of the guide rotary member 3. Furthermore, each panel 20 may be forcedly carried into the guide rotary member 3 by the connecting belt 16, so that in case the shutter curtain is closed at a high speed, it can deal with the high speed shifting of the continuously moving panels 20 without the succeeding panel getting hooked, whereby accidental breaking of the panel can be positively prevented.

Moreover, referencing FIG. 1, when the shutter curtain is to be open or closed at a high speed, the panel 20 positioned just under the panel 20 descending from the housing case 1 is fitted with its rib 25 engaged in the groove 24 of the panel above it, and the panels descend by being supported by means of the connecting belt 16, so that the descending taken place such that each panel stays in positive contact, and there is no gap at all in which a finger may be pinched, and thus, the occurrence of finger pinching can be positively prevented.

Also, since the connecting chain 15 is always loaded only with the weight of one sheet of panel, a low cost chain of lower grade may be used.

Figure 4:
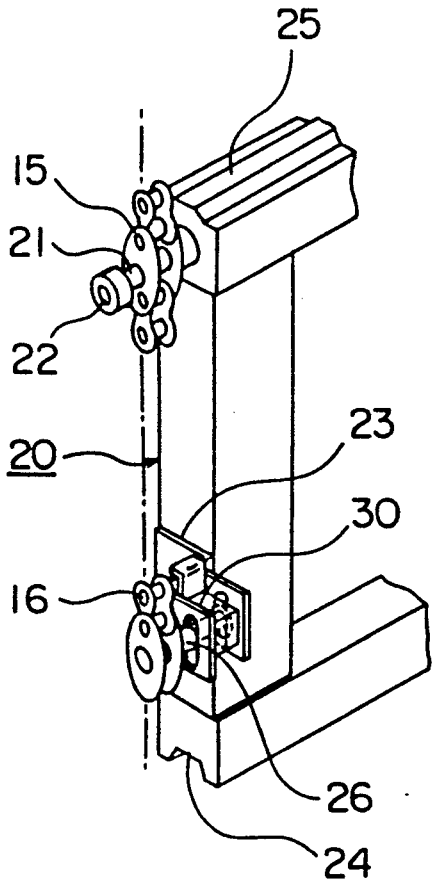
FIG. 4 is a perspective view of a portion of side end surface of the panel representing another embodiment.

In the foregoing embodiment, the description is provided with respect to the condition where the guide shaft 23 is formed in the shape of a crank, but this embodiment is not limited to such a guide shaft, and as shown in FIG. 4, it is formed in an h-shape configuration when viewed from above, and a cubic resin block 30 through which the guide shaft 26 passes may be inserted into the inside between the legs of the "h" to increase the strength of the guide shaft mounting plate 23.

Also, in the foregoing embodiment, the description is provided with respect to the case where the number of teeth (not shown) of the sprocket 2 and the guide rotary member 3 are different, and the carrying speed of the connecting chain 15 is made to be faster than that of the connecting belt 16, but this embodiment is not limited to the foregoing modification, and the number of teeth of the sprocket 2 and the guide rotary member 3 may be made equal. Also, the pitches of the roller chains may be different, or the rotating speeds of the sprocket 2 and the guide rotary member 3 may be different so that the carrying speed of the connecting chain 15 is made to be faster than that of the connecting belt 16. The connecting belt 16 may be made from chain or the wire.

Figure 5:
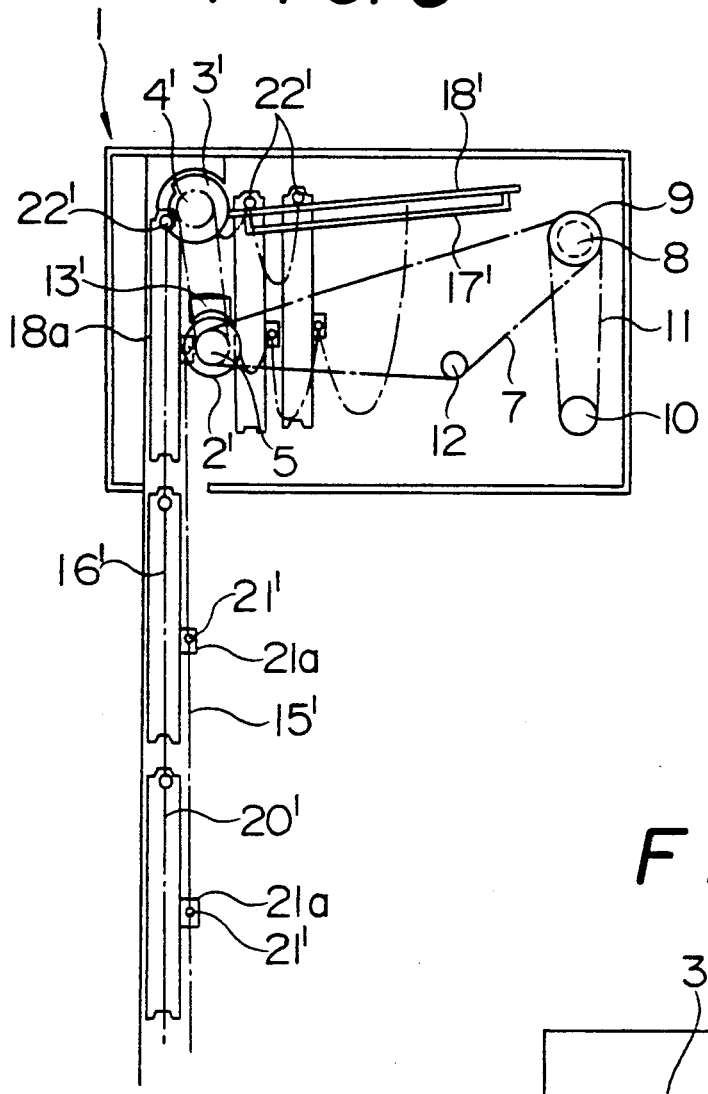
FIG. 5 is a side view of the panel shutter representing the second embodiment of the invention.
Figure 10:
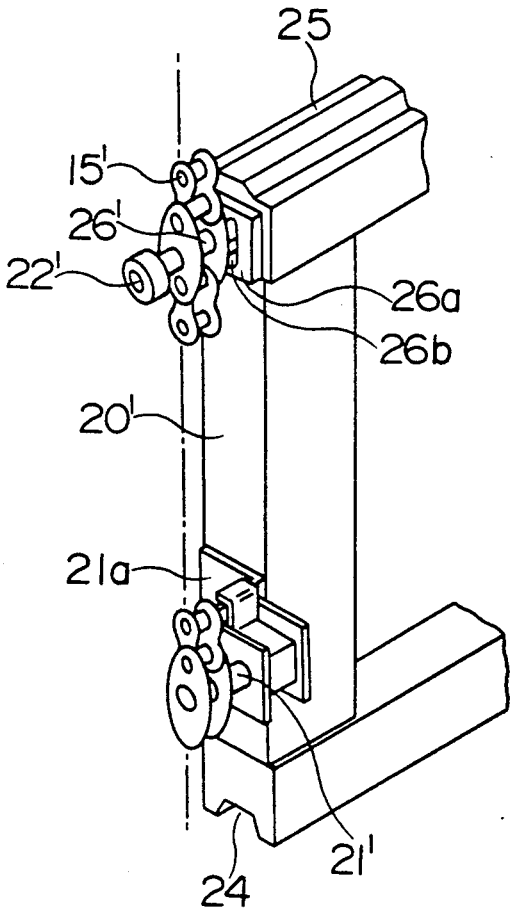
FIG. 10 is a perspective view of portion of the side end surface of a panel used in the embodiment of FIG. 9.

FIG. 5 though FIG. 10 represent the second embodiment of the invention, and the different points between the first embodiment and the second embodiment are such that the arrangement and construction of the sprocket 2 and the guide rotary member 3 or the arrangement and construction of the support shaft 21 and the guide shaft 26 are reversed. Namely, in the first embodiment, the sprocket 2 is disposed in the vicinity of the housing rail 18, while the guide rotary member 3 is disposed in the lower part of housing case 1, and in the second embodiment, the guide rotary member 3' is disposed in the vicinity of the housing rail 18', and the sprocket 2' is disposed in its lower part of housing case 1.

Hereinbelow, the detailed description of the invention is provided on the basis of FIGS. 5–10 the drawings, in which the guide rotary member 3' disposed in the vicinity of the housing rail 18, and also, the sprocket 2' disposed are respectively and rotatably provided in the housing case 1. The sprocket 2' and the guide rotary member 3' are arranged to be synchronously and rotatably driven in the same direction by the opening/closing drive unit 10. The connecting chain 15', mounted on the support shaft 21' that projects on the under side of the panel 20' by means of the support shaft mounting plate **21*a*', is suspended on the sprocket 2', and the guide shaft 26' provided on the upper side of the panel 20' is engaged or disengaged with the guide rotary member 3', and the opening in the wall of the building is arranged to be open or closed by the continuous lifting movement of the panels along the guide rail 18 that guides the upper guide roller 22' provided on the guide shaft 26' and the lateral shift along the housing rail 18'**.

Figure 6:
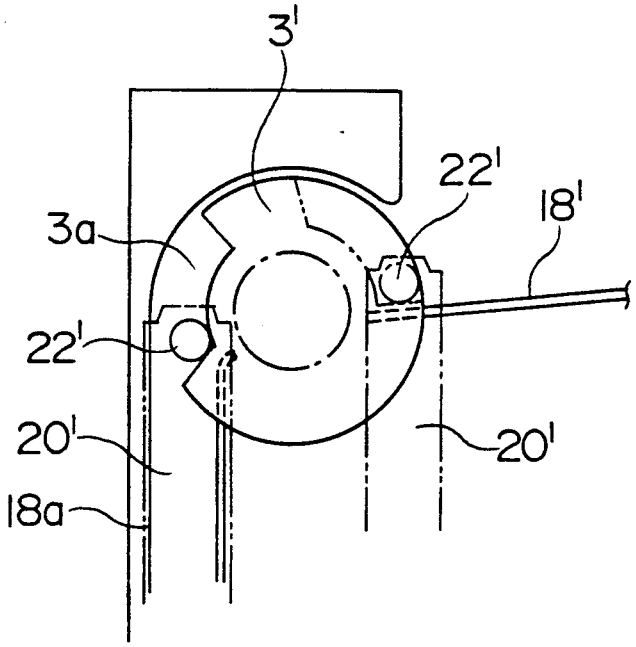
FIG. 6 is a side view of a guide rotary member.

The guide rotary member 3' shown in FIGS. 5 and 6 is formed with a receiving groove **3*a* for receiving the guide roller 22' mounted on the guide shaft 26', and this receiving groove 3*a*, as shown in FIG. 6, is formed in such a way that its side that receives the lifted panel 20' is shaped as an obtuse angle on the side 18*a* of the guide rail 18 and its side that receives the laterally shifted panel 20' is shaped as an acute angle. Housing rail 18, is sloped moderately downwardly toward guide rotary member 3'**.

The speed ratio of the sprocket 2' and the guide rotary member 3' is such that the external periphery of the sprocket 2' is set to be equal to ½ of the length of the connecting chain 15' between the support shafts 21' of the panels 20', and the setting is made so that the synchronous rotatable drive is made at the speed ratio of 2:1, such that when the sprocket 2' makes two rotations the guide rotary member 3' makes one rotation. Accordingly, the carrying of the panels 20' horizontally is such that the support shaft 21' and the guide shaft 26' start to shift by the sprocket 2' and the guide rotary member 3' in the beginning of the horizontal movement, and when the sprocket 2' makes a half turn, the guide rotary member 3' makes ¼ turn, and the upper guide roller 22' if the guide shaft 26' shifts on the circumference of the receiving groove **3*a* to complete the horizontal movement onto rails 18'**.

The foregoing guide rail **18*a* is formed in such a way that the inside surface of the housing case extends circumferentially to the side of the housing rail 18' adjacent the guide rotary member 3', and thus disengagement of the guide shaft 26 and the receiving groove 3*a* in the middle of the movement cycle is prevented, and a chain holder 13' is provided on the upper side of the sprocket 2', and thus, the meshed condition with the connecting chain 15'** is likewise secured.

Figure 7:
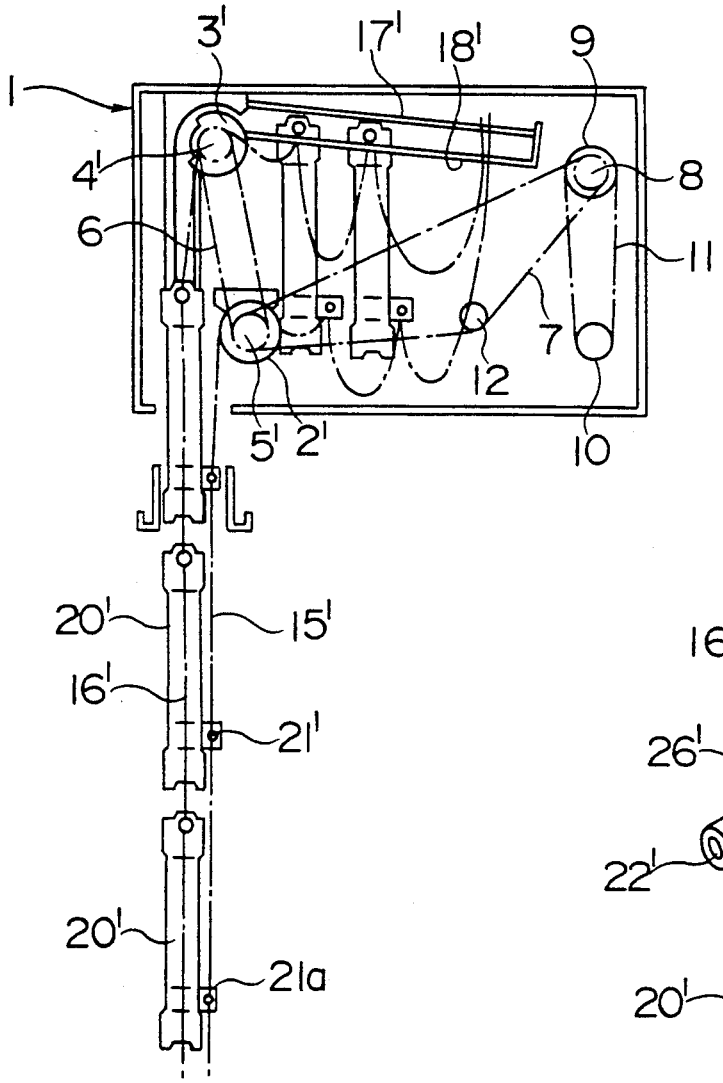
FIG. 7 is a side view of the panel shutter representing another embodiment.
Figure 8:
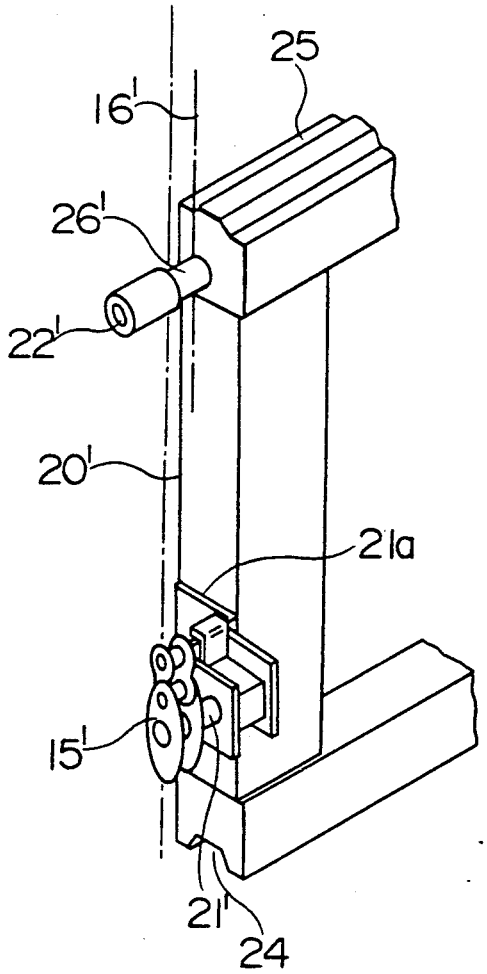
FIG. 8 is a perspective view of portion of the side end surface of a panel used in the embodiment of FIG. 7.
Figure 9:
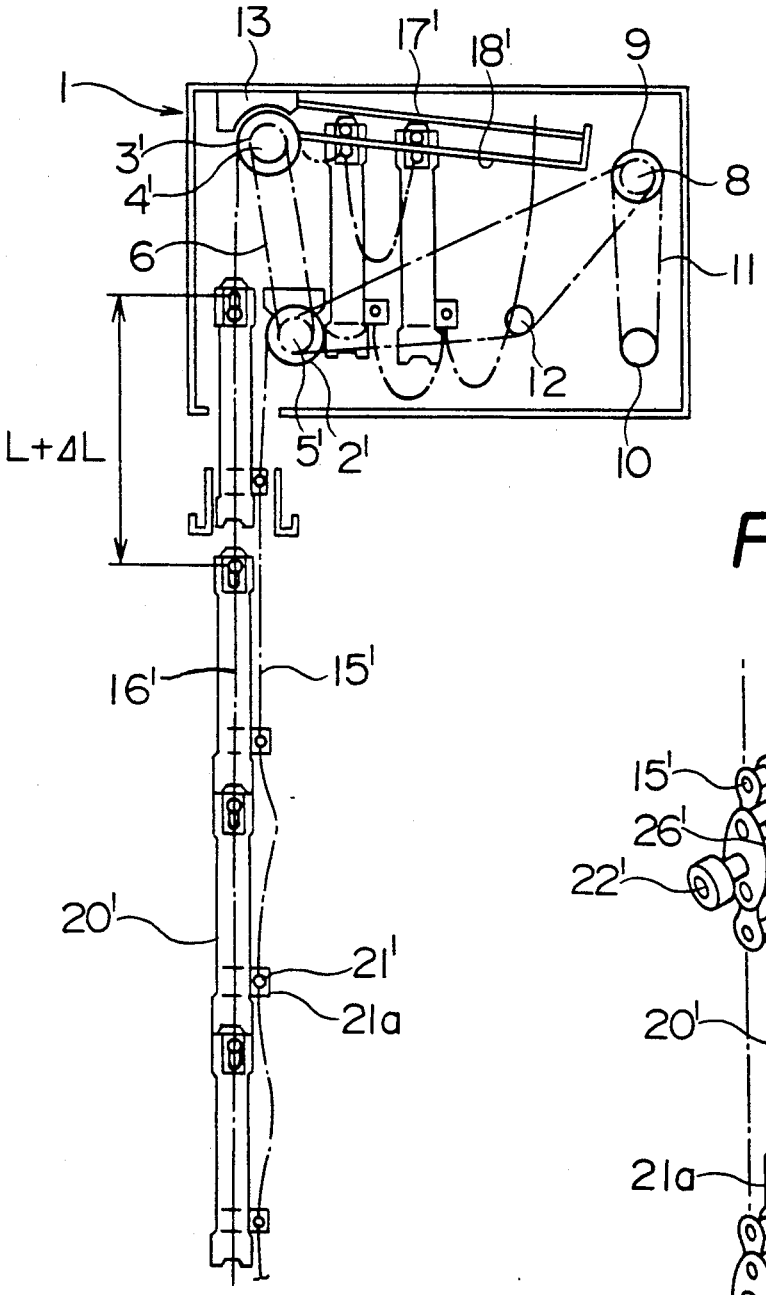
FIG. 9 is a summary side view of the panel shutter representing another embodiment.

Reference numeral 16' denotes a connecting belt to be made from rope, wire or chain and the like, and the connecting belt 16' is linked by means of the guide shaft 26' projected on the upper end of each panel 20' in order to draw the rear panel 20' to the side of the rotary guide member 3' so that each panel 20', 20' . . . travelling on the housing rail 18' follows the preceding panel 20' during closing of the shutter curtain in which case the housing rail 18' is tilted downwardly rearwardly from the upper position of the guide rotary member 3'. Also, the guide rotary member 3' shown in FIG. 7 is the same as the member shown in FIGS. 5 and 6, but the guide rotary member 3' is not limited to those shown in the drawings, and a gear shape with a smaller width of receiving groove **3*a* for engagement or disengagement with the guide shaft 26' may be used. In case the gear shaped guide rotary member 3' is used, not only is the sprocket 2' and the guide rotary member 3' to be synchronously and rotatably driven at the speed ratio of 2:1, but also, both of these members may be set to be synchronously and rotatably driven at the identical speed, and as suggested by FIGS. 9 and 10, the guide rotary member 3' is made to have the same number of teeth as the sprocket 2', and the connecting belt 16' made from chain is used to suspend the panels 20', and the setting is made so that the sprocket 2' and the guide rotary member 3' are synchronously and rotatably driven in the same direction at the identical speed. Construction may be provided to prevent swinging at the upper end side or the lower end side of the panels 20'**.

Also, in order to prevent finger pinching at the time of closing the shutter curtain, where the connecting belt 16' is made from chain, as shown in FIG. 10, the guide shaft 26 is mounted slidably in the vertical direction in the long circular hole **26*b* provided on the guide shaft mounting plate 26*a*, and the relationship of the sprocket 2' and the guide rotary member 3' is set so that the pitches are equal, and the number of teeth of the sprocket 2' is set to be greater than the number of teeth of the guide rotary member 3', and the carrying speed $V_1$ of the connecting chain 15' and the carrying speed $V_2$ of the connecting belt 16'** satisfies the formula:

$$(V_1-V_2)T=\Delta L,$$

whereby during lifting of the panels in the guide rail 18a, all of the panels 20' move without a gap being produced due to the rotation of the guide rotary member 3', and in the continuous transition zone from vertical lifting to horizontal shifting, the carrying speed of the connecting chain 15' to be driven by the sprocket 2' is faster, and the preceding panel 20' is lifted faster than the panel 20' beneath, and the preceding panel 20' floats and a gap is caused between the preceding panel 20' and the panel 20' beneath, and the continuous lifting movement and the lateral shift takes place smoothly. Moreover, in case of using a connecting belt such as rope, wire and the like, similar to the third embodiment of the invention to be described hereinafter, the panel support member 15a (FIG. 11) is pivotally mounted on the connecting belt 15'' at a pitch equal to the height of the panel. The support shaft 21'' formed on the panel 20'' is journalled on the panel support member 15a, and the panel support member 15a is swivelled at a position of the sprocket 2''. The ring-like member 3b is capable of vertically shifting the panel 20'' a small amount (See FIG. 12), and at the time of the shift upwardly of one panel 20'' in the guide rail, the panels 20'' beneath move without a gap due to the rotation of the sprocket 2'' pulling belt 15'', and in the transition zone the preceding panel 20'' will thus be continuously carried horizontally upon separation from the next lower side panel 20''.

In the embodiment of the second invention constructed as described in the foregoing, the shutter curtain is suspended by the connecting chain 15' by means of the support shaft 21' projecting from the lower part of each panel 20', and the shutter curtain is made to open or close through the continuous movement process of the lifting shift along the guide rail 18a in the vertical direction and the lateral shift along the housing rail 18' in the horizontal direction by interlocking with the reversible sprockets 2' disposed in the lower part of the housing case 1. Each panel 20' in the storing process tends to cause swinging on the upper side of the panel 20', but in order to prevent this, the guide rotary member 3' acting as the forced guide mechanism, is provided in the vicinity of the housing rail 18', and when the guide shaft 26' projecting from the upper side of each panel is engaged or disengaged with the receiving groove 3a provided on the guide rotary member 3', the free swinging of the upper side of the panel is prevented. Accordingly, when the lower side of the panel 20' is suspended by the connecting chain 15', the lower side of each panel 20' precedes always from the upper side of the next lower panel 20, whereby the storing process is completed. Particularly, since the shifting to the guide rail of the lower side of the panel 20' during closing of the shutter is faster, the time lag by the upper side of the panel 20' may be ignored as compared with the conventional case.

Also, since the linkage is produced by the connecting belt 16' by means of the guide shaft 26' projecting from the upper end of each panel 20', in case the housing rail 18' is disposed to be tilted downwardly from the upper position of the guide rotary member 3', the rear panel 20' is made to be drawn to the guide rotary member 3 by causing each panel 20', 20' . . . travelling on the housing rail 18' to follow the preceding panel 20' during the closing operation. Although the connecting belt 16' is linked with the guide shaft 26', this invention is not limited to this embodiment. Furthermore, the guide rotary member 3' is constructed with the number of teeth identical with that of the sprocket 2', and the connecting belt 16' made from the chain is suspended from member 3', and the design is made to allow the synchronous rotation drive of the sprocket 2' and the guide rotary member 3' in the same direction at the same speed. The carrying of the upper side and the lower side of the panels 20' takes place simultaneously, and the suspending of the panels is maintained by both the connecting chain 15' and the connecting belt 16' without causing the swinging on either side, whereby the load applied on the panel is dispersed, and the connecting chain can be constructed with a chain of lower grade.

Furthermore, in order to prevent the finger pinching at the time of closing the shutter curtain, where the connecting belt 16' made from the chain is used, the guide shaft 26' is made slidable in the vertical direction on a long circular hole 26b provided on the guide shaft mounting plate 26a, and the relationship of the sprocket 2' and the guide rotary member 3' is constructed similar to the first embodiment of the invention.

FIGS. 11 through 16 represent the third embodiment of the invention, and reference numeral 1 denotes a housing case, and a take-up device 2a is disposed at the right and left inside side surfaces.

Figure 13:
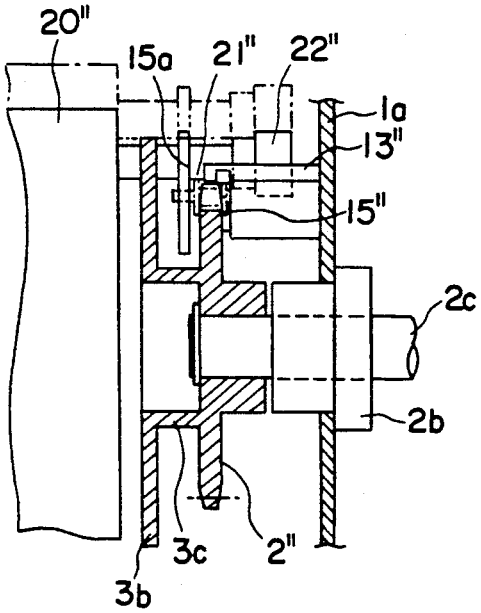
FIG. 13 is a vertical cross-section of FIG. 12.

This take-up device 2a, as shown in FIG. 13, is rotatably supported on a bracket plate la fixed to the housing case 1 by means of a bearing 2b, and a sprocket 2'' engaged with the connecting chain 15'' of a predetermined length is provided, and this sprocket 2'' is connected to a middle sprocket 9 that is rotatably driven by an opening/closing driver unit 10 by means of an endless chain 7' to perform the rotational drive.

Figure 12:
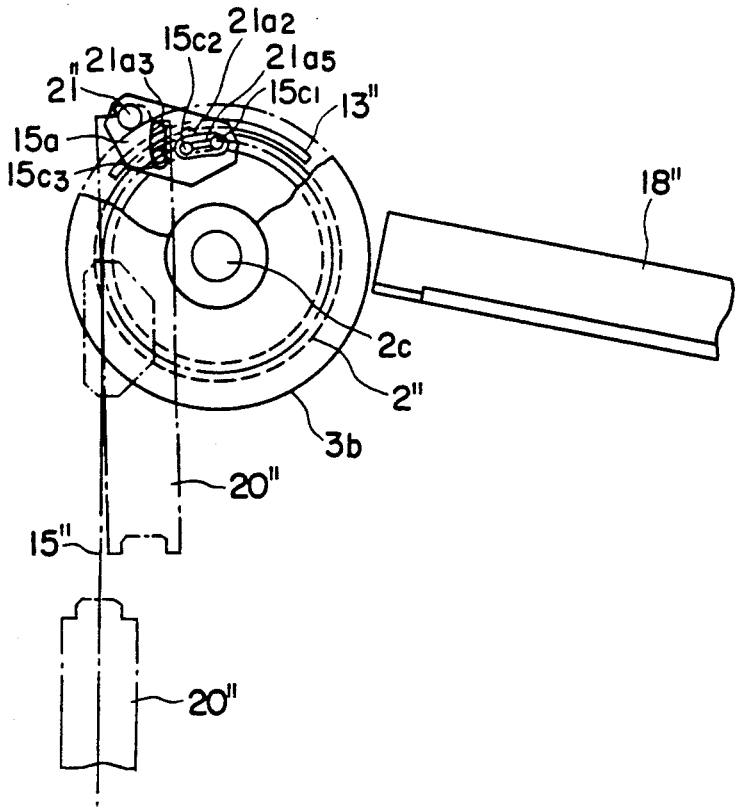
FIG. 12 is a side view representing the sprocket whose part is notched.

Also, the sprocket 2'', as shown in FIGS. 12 and 13, is fixed to a rotary shaft 2c journalled on the bracket plate 1a by means of the bearing 2b, and a ring-like member 3b acting as a guide member which is in parallel with the sprocket 2'' is integrally mounted on its outside surface by means of a cylindrical spacer 3c. The outside diameter of the ring-like member 3b is selected to be of a large diameter as compared with the outside diameter of the sprocket 2''. Also, the bracket plate 1a is fixed with a chain holder 13'' that guides an outer peripheral edge of the connecting chain 15'' engaged with the sprocket 2'' to prevent disengagement therefrom.

Furthermore, at the rear side of the sprocket 2'', the housing rail 18'' is slightly tilted downwardly which guides the upper guide roller 22'' of the panel 20 to be described hereinafter, and a chain guide 17'' for engaging one end of the connecting chain 15'' is disposed at the upper side of the housing rail 18''. Also, at the lower position of the sprocket 2'', a roller guide 40 consisting of two sheets of generally V-shaped guide rails 40a, 40b is disposed almost parallel to one another by keeping a predetermined interval to guide the lower guide roller 26a of the panel 20'' to be described hereinafter.

Figure 14:
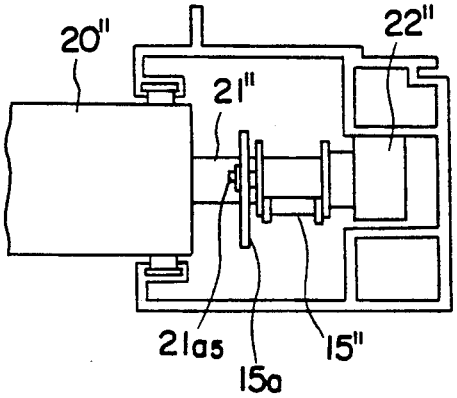
FIG. 14 (*a*), (*b*), (*c*) are a plan view, a side view, and an elevation view of the connecting chain mounted with the panel support member, respectively.
Figure 14:
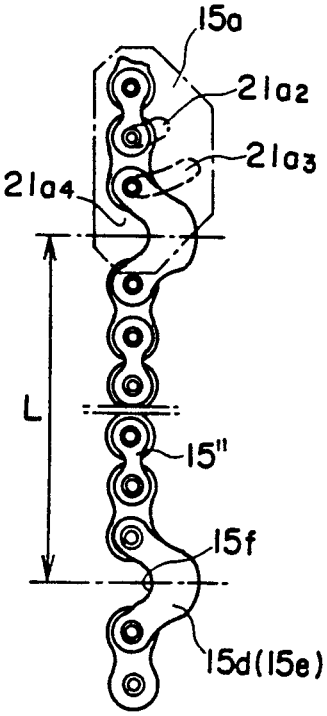
Figure 14:
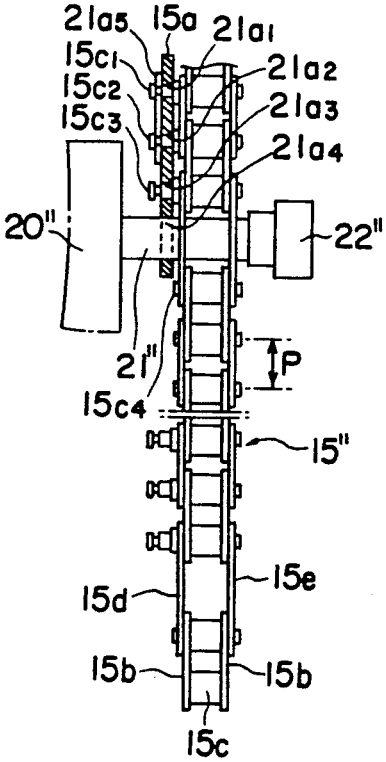

The connecting chain 15'', as shown in FIGS. 14 (*a*)–(*c*), is constructed in such that a pair of links 15b, 15b having a predetermined pitch P is fixed by means of a pin 15c by keeping a predetermined interval, and the adjacent three pieces of pins $15c_1$–$15c_3$ project leftward when viewed in FIG. 14(*c*) at an interval equal to the panel height L of the panel 20'' to be described hereinafter, and a pin $15c_4$ adjacent to the pine $15c_3$ on the lower side is separated by 2 pitches, and the space of 2 pitches is linked by genreatly v-shaped deformed links 15*d* and 15*e* forming a curved concave portion 15*f* in the center portion as shown in FIG. 14 (*b*).

A trapezoid type panel support member 15*a* is disposed to be swivelled on pins $15c_1$–$15c_3$ of the connecting chain 15 within a predetermined range. This panel support member 15*a* is formed with a through hole $21a_1$ to be engaged with the pin $15c_1$ and arc shaped grooves $21a_2$, $21a_3$ with the center portion of a through hole $21a_1$ to be engaged with pins $15c_2$, $15c_3$ as its center, and a through hole $21a_4$ to which the support shaft 21″ of the panel 20″ runs through rotatably is formed at a position corresponding to the curved concave portion 15*f* of the deformed links 15*d* and 15*e*, and is mounted pivotally by means of a stop ring $21a_5$.

The panel 20″ is formed with the support shafts 21″ at a position toward the upper part of its right and left end surfaces which project symmetrically to the right and left, and these support shafts 21″ run through the through hole $21a_4$ of the panel support member 15*a* and extend outward of the connecting chain 15″. The upper guide roller 22 is mounted on the extended end of shaft 21″, and a lower guide roller 26*a* is mounted on the back surface side of panel 20″, and, furthermore, a convex rib 25 is formed on the upper end surface of panel 20″, and a concave groove 24 for mating with rib 25 is formed on the lower end surface of panel 20″.

Figure 11:
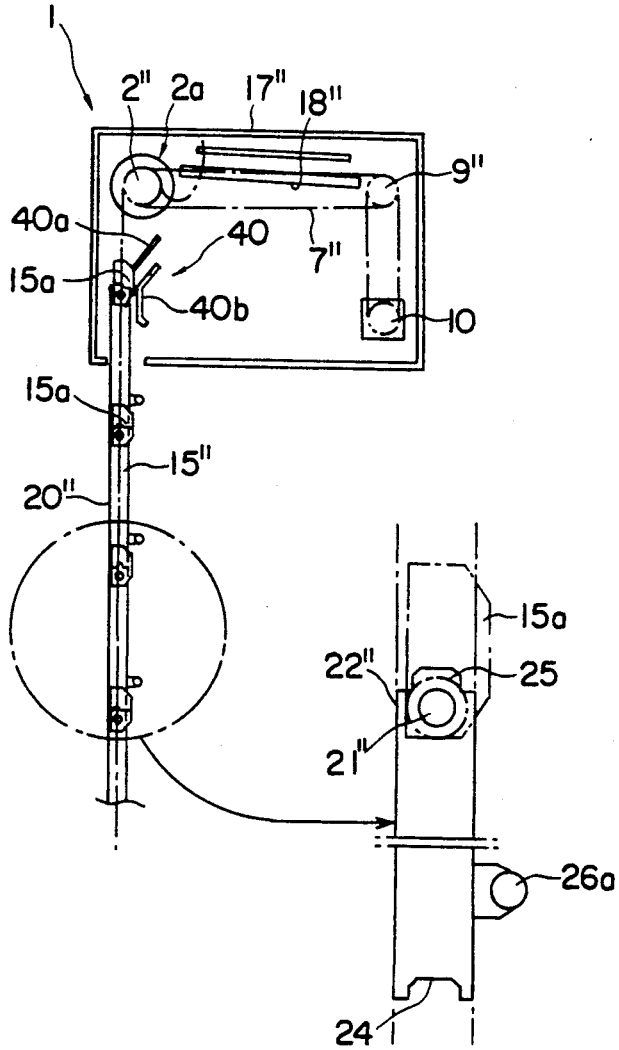
FIG. 11 is a summary construction view of the panel shutter representing the third embodiment of the invention.

Next, the operation of the foregoing embodiment is described. As shown in FIG. 11, it is assumed that a shutter curtain is formed by suspending each panel 20″ on the connecting chain 15″. In this condition, the panel support member 15*a* is mounted pivotally on the connecting chain 15″ at an interval identical with the height L of the panel 20″, and since the support shaft 21″ of the panel 20″ is supported on the panel support member 15*a*, the rib 25 of the adjacent panel 20″ is fitted with the concave groove 24 of the adjacent panel 20″ in the suspended condition of the panels 20″, and the opening in the building can be closed while each panel 20 stays in contact.

When the sprocket 2″ is rotatably driven by the drive of the opening/closing drive unit 10 from this condition, and the connecting chain 15″ is pulled upwardly until the panel support member 15*a* supporting the top panel 20″ reaches the sprocket 2″, and all of the panels 20″ are lifted integrally. But when the panel support member 15*a* supporting the top panel 20″ reaches the position of the sprocket 2″, the support shaft 21″ of the panel supported by the panel support member 15*a* comes to be engaged with the outer peripheral surface of the ring-like member 3*b* mounted on the sprocket 2″.

In this condition, when the sprocket 2″ continues its rotation, on account of the selection of the outside diameter of the ring-like member 3*b* which is larger than the outside diameter of the sprocket 2″, the vertical shifting amount of the support shaft 21 becomes gradually larger than the shifting amount of the connecting chain 15″, and as a result, the fit between the concave groove 24 of the lower end surface of the top panel 20″ and the convex rib 25 for the lower end surface of the lower side panel 20″ is gradually eliminated.

Figure 15:
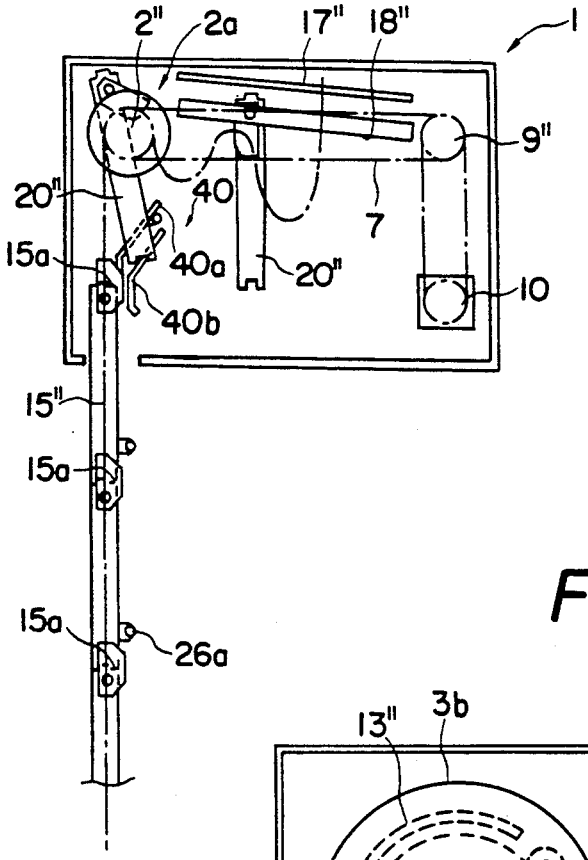
FIG. 15 is a side view similar to that of FIG. 11 with some panels already collected in the housing case.

When separation occurs, the lower guide roller 26*a* of the panel 20″ is guided to a guide rail 40*a* of roller guide 40, whereby it shifts the inclination of the panel 20″ by rotation in the anticlockwise direction from the perpendicular surface as shown in FIG. 15.

Then, when the ring-like member 3*b* rotates together with the sprocket 2″, and the upper guide roller 22″ is engaged with an upper end of the housing rail 18″, the lower guide roller 26*a* is disengaged from roller guide 40, and the connecting chain 15″ is disengaged from the sprocket 2″, and the panel 20″ is suspended in the condition where the upper guide roller 22″ is engaged with the housing rail 18. When the sprocket 2″ further rotates, additional panels 20″ are acted upon in the same way, the upper guide rollers 22″ are guided on the housing rail 18″ to be suspended, and the panels in the housing case 1 are sequentially pushed to the back of housing case 1.

As described in the foregoing, when each panel 20″ is housed in the housing case 1, the drive of the opening/-closing drive unit 10 is suspended, and the opening function is completed in this condition, whereby the full open condition is brought about.

Furthermore, when the opening/closing drive unit 10 is driven counter to the foregoing description from the full open condition, the sprocket 2″ reversely rotates, the connecting chain 15″ engaged with the sprocket 2″, and the foremost panel 20″ engaged with the housing rail 18″ is drawn toward sprocket 2, and the upper guide roller 22″ of the panel 20″ is disengaged from the housing rail 18, whereby the support shaft 21″ is engaged with the ring-like member 3*b* of the sprocket 2″.

Figure 16:
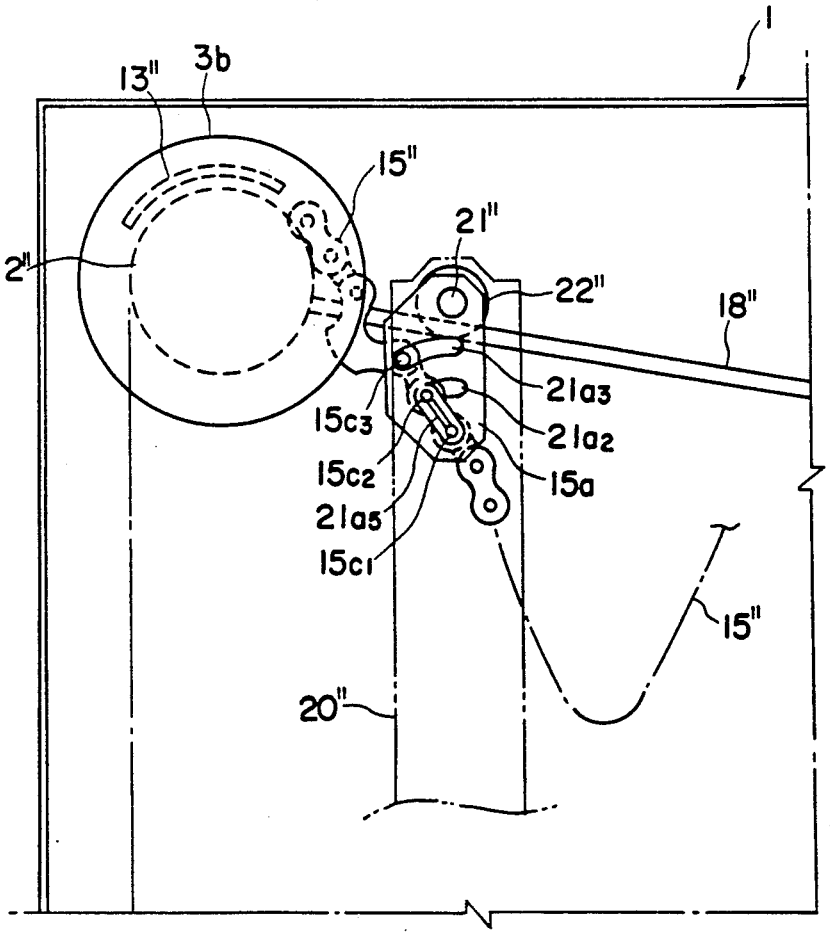
FIG. 16 is a view representing the condition of the panel support member between the housing rail and the sprocket.

In this case, the panel support member 15*a* is oriented in its pivoting range via arc shaped grooves $21a_2$ and $21a_3$ so that the member 15*a* is not tilted to the rear of the panel 20 when the housing rail 18″ shifts to the sprocket 2″ as shown in FIG. 16, and the support shaft 21″ and the ring-like member 3*b* can be smoothly engaged.

When the panel support member 15″ shifts to the sprocket 2″, the lower guide roller 26*a* abuts on the guide rail 40*a* of the roller guide 40, and the panel 20″ descends according to the rotation of the sprocket 2″, and the lower guide roller 26*a* is guided by the guide rails 40*a* and 40*b* so that the position of the lower guide roller 26*a* is controlled. In the meantime, the support shaft 21″ descends in arc shape according to the rotation of the ring-like member 3*b* and the shaft approaches gradually the upper end of the lowest preceding panel 20″ and the fitting of the concave groove 24″ with the convex rib 25″ starts according to the approaching motion, and when the support shaft 21″ releases the engagement with the outer peripheral circle of the ring-like member 3*b*, the convex rib 25″ of the preceding panel 20″ and the concave groove 24 of the succeeding panel 20″ produces the complete fitted condition whereby an integral unit of both the panels descends.

Thereafter, the succeeding panels 20″ descend sequentially in the fitted condition with the preceding panels 20″ and they sequentially descend without causing the gap between each panel 20″, and when the lowest panel 20″ touches the ground, the rotation of the sprocket 2″ stops.

As described in the foregoing, since the lifting and descending of the panels are taken place without causing the gap between the adjacent panels 20′ at the time of the vertical movement of the panels 20″, there is no apprehension at all of causing a finger pinching accident which causes an injury by pinching the finger between the panels at the time of lifting and descending of the panels 20″, and moreover, and extremely simple construction for such purpose is provided which the panel support member 15*a* is pivotally mounted on the connecting chain 15", and the panel support member 15*a* is pivoted to the position of the sprocket 2" to provide more shifting of the panel 20" than the shifting amount of the connecting chain 15", and the ring-like member 3*b* acts as a guide member that eliminates the fitted condition between the panels 20", and there is no need of providing complicated shaped roller guides and the like, and the installation work can be done easily.

In the foregoing embodiment, the guide member that causes the shifting amount of the panel 20" longer than the shifting amount of the connecting chain 15" is described for the case where the sprocket 2" is integrally formed with the ring-like member 3*b*, but this invention is not limited to this embodiment. For example, the chain holder 13" provided for preventing the disengagement of the connecting chain 15" is made to extend to the lower end side of the sprocket 2" and the upper guide roller 22" is mounted on the chain holder 13" to be guided to swivel the panel support member 15*a*, and also, in this case, tee chain holder 13 is not required to be of an arc shape. It may only be provided for the time being from the engagement of the lower guide roller 26*a* of the panel 20" with the roller guide 40 to the condition where its lower end is in discord with the upper end of the panel.

Also, in the foregoing embodiment, description is provided for the case where the deformed links 15*d* and 15*e* are mounted on the connecting chain 15", but the support shaft 21" may be arranged to abut on the links 15*b* and 15*c* of the connecting chain 15 directly by omitting these deformed links 15*d* and 15*e*.

Furthermore, in the foregoing embodiment, description is provided for the case where the plate-like panel support member 15*a* is employed as the panel support member, but this invention is not limited to the foregoing embodiment, and as long as the construction is provided in which the connecting chain 15" is pivotally mounted and the support shaft 21" of the panel 20" is to be supported, the support member 15*a* may be made in many forms such as a block member and the like not limiting to the plate-like member.

Also, in the foregoing embodiment, description is provided for the case where the support shaft 21" is made to extend by running through the panel support member 15*a*, and the upper guide roller 22' is mounted on its extended end, but the upper guide roller 22" may be mounted on the panel support member 15*a* instead of using the support shaft 21.

As will be obvious from the foregoing description, according to this invention:

(1) In the panel storing and retrieving process according to one embodiment of the invention, the delay at the lower side of the panel resulting from the slightly faster carrying of the panel end of the sprocket 2 side of the panel 20 than the panel end of the guide rotary member 3 is prevented by performing the engagement or disengagement of the guide shaft 26 forcedly by the rotary guide member 3, and moreover, each panel 20 may be forcedly carried into the guide rotary member 3 by the connecting belt 16 so that in case the shutter curtain is closed at a high speed, it can deal with the high speed shifting of the panels 20 in the continuous movement process, and heretofore, the lower end side of the panel, functioning as the free end, swivels or swings back and forth in the horizontal direction, with the roller shaft 21 acting as a fulcrum, by the motion inertia, and the succeeding panel may become hooked and the panel will not be carried on the housing rail or the guide rail, which results in the inability of ascending or descending whereby accidental breaking of the panel can be positively prevented.

Moreover, each panel 20 is fitted to the preceding panel 20 at the position where each panel 20 slightly descends from the housing case 1 at the time of descending of the panel 20, although the opening and closing may take place at a high speed, and thereafter, each panel descends while being supported by the connecting belt 16 individually so that the descending takes place in the condition where each panel is in positive contact, and there exists no gap for pinching the fingers.

(2) According to another embodiment of the invention, each panel in the storing and retrieval process causes a delay on the upper side of the panel 20, but the guide shaft projecting from the upper side of each panel is forcedly engaged and disengaged with a guide rotary member 3 that is a forced guide mechanism for preventing the delay, whereby the delay on the upper side of the panel can be prevented. Accordingly, the lower side of the panel 20 is suspended so that the under side of the panel 20 is completely and continuously carried out always by preceding to the upper side of the panel 20, and particularly, the shifting to the guide rail of the under side of the panel 20 at the time of the continuous panel movement takes place faster, and as a result, the time lag owing to the delay of the upper side of the panel 20 can be ignored when compared with the case where the delay occurs on the lower side of the panel 20, and moreover, the upper side of the panel 20 is engaged with the guide rotary member 3 in the condition where the pivoting motion is controlled by rolling on the housing rail 18 already, whereby even if the pivoting motion occurs on the lower side of the panel 20, the positive continuous movement still takes place.

Moreover, when opening and closing takes place at high speed, each panel 20 is fitted to the preceding panel 20 at the position where each panel 20 slightly descends from the housing case 1 at the time of descending of the panel 20, and thereafter, the descending takes place in the condition where each panel is in positive contact, which produces totally no gap allowing the insertion of the finger.

(3) During continuous movement of the panel 20, a gap is caused to occur between the adjacent panels 20 vertically at the position of the sprocket 2, and the fitted condition of adjacent panels 20 is caused to disengage, and at the time of lifting, the lifting of the panels 20 takes place in the condition where each panel 20 is completely fitted so that there is totally no apprehension of causing finger pinching at the time of lifting and descending of the panels 20. Moreover, an extremely simple construction is provided in which the panel support member 15*a* is pivotally mounted on the connecting chain 15, and the panel support member 15*a* is caused to swivel or pivot at the position of the sprocket 2, and the shifting amount of the panel 20 is made larger than the shifting amount of the connecting chain 15, and the ring-like plate 3*b* acts as a guide member that eliminates the fitted condition of the panels. There is no need of providing complicated shaped roller guides and the like, and the installation work can be done easily.

INDUSTRIAL UTILIZATION

The panel shutter device according to this invention can be utilized for panel shutters that can be installed in the opening of buildings such as factories, warehouses, housings in general, stores and the like. Particularly, the device is useful as the equipment for securing property and at the same time prevents finger pinching during the closing operation in addition to the high speed opening and closing of the panel shutters.

We claim:

1. A panel shutter apparatus, comprising:

a plurality of panels defining a shutter, each panel having a top edge, a bottom edge, and two side edges, each panel having a support shaft projecting laterally from adjacent the top of each said panel and a guide shaft projecting laterally from adjacent the bottom of each said panel;

a pair of vertically disposed guide rails, between which said panels extend, for guiding the side edges of said panels along said guide rails as said panels are raised and lowered;

a first connecting strip joining the guide shafts of adjacent panels;

a second connecting strip joining the support shafts of adjacent panels;

a housing, including a pair of horizontal housing rails for receiving said support shafts of said panels, for storing said panels in vertically oriented side-by-side relationship as said panels are raised; and reversible drive means in said housing, including a rotary guide member for engaging said first connecting strip and driving said first connecting strip in forward and reverse directions to respectively raise and lower said panels, said drive means further including a wheel engaging said second connecting strip and driving said second connecting strip in forward and reverse directions to respectively raise and lower said panels; whereby both the top and bottom of each said panel are, respectively, positively drawn into said housing from said vertical guide rails and dispensed from said housing to said vertical guide rails upon raising and lowering of said panels, without jamming.

2. The apparatus as claimed in claim 1, wherein;

said first connecting strip joins the guide shafts of adjacent panels at a spacing substantially equal to the height of a panel;

said second connecting strip joins the support shafts of adjacent panels at a spacing greater than the height of a panel; and said drive means includes means for driving said second connecting strip at a velocity greater than that of said first connecting strip, the relationship between the velocities of the two connecting strips being chosen such that adjacent panels, immediately prior to being drawn into said housing or dispensed therefrom, are separated from one another to form a gap therebetween, and all other panels beneath are in contact within adjacent panels.

3. The apparatus as claimed in claim 1, wherein:

said wheel is a sprocketed wheel with sprocket teeth;

said second connecting strip is a chain meshed with said sprocket teeth; and said first connecting strip is a belt.

4. The apparatus as claimed in claim 1, wherein both said first and second connecting strips are chains.

5. The apparatus as claimed in claim 2, wherein each said panel includes means for mounting said guide shaft to be slidable in the vertical direction.

6. The apparatus as claimed in claim 2, wherein said drive means includes means for interlocking said wheel and said rotary guide member so that said wheel and said rotary guide members are rotatably driven synchronously.

7. The apparatus as claimed in claim 6, wherein:

said first and second connecting strips are driven at the same velocity; and said second connecting strip includes spaced apart members which, upon reaching said wheel, engages with the periphery of said wheel to effectively increase the radius of said wheel, thereby temporarily increasing the velocity of said second connecting strip relative to said first connecting strip.

8. The apparatus as claimed in claim 6, wherein the diameter of said wheel is greater than the diameter of said rotary guide member, thereby making the velocity of said second connecting strip greater than that of said first connecting strip.

9. The apparatus as claimed in claim 7, wherein:

said spaced apart members define panel support members pivotally mounted on said second connecting strip at a spacing equal to the height of said panel; and said support shaft on each panel is journalled to its corresponding panel support member.

10. The apparatus as claimed in claim 1, wherein:

said second connecting strip joins the support shafts of adjacent panels at a spacing substantially equal to the height of a panel;

said first connecting strip joins the guide shafts of adjacent panels at a spacing greater than the height of a panel; and said drive means includes means for driving said first connecting strip at a velocity greater than that of said second connecting strip, the relationship between the velocities of the two connecting strips being chosen such that adjacent panels, immediately prior to being drawn into said housing or dispensed therefrom, are separated from one another to form a gap therebetween, and all other panels beneath are in contact with adjacent panels.

11. The apparatus as claimed in claim 10, wherein both said first and second connecting strips are chains.

* * * * *